United States Patent [19]

Rachanski

[11] Patent Number: 4,651,596

[45] Date of Patent: Mar. 24, 1987

[54] DIFFERENT TAPER STUD REMOVER/INSTALLER

[75] Inventor: Michael A. Rachanski, Burbank, Ill.

[73] Assignee: EEM Rachanski Enterprises, Inc., Burbank, Ill.

[21] Appl. No.: 779,498

[22] Filed: Sep. 24, 1985

[51] Int. Cl.[4] ..... B25B 13/50

[52] U.S. Cl. ..... 81/53.2; 29/264

[58] Field of Search ..... 81/53.2; 29/256, 261, 29/263, 264, 265

[56] References Cited

U.S. PATENT DOCUMENTS

| | | | |
|---|---|---|---|
| 2,497,214 | 2/1950 | Dreyer | 81/53.2 |
| 2,719,445 | 10/1955 | Giebler | 81/53.2 |
| 3,529,497 | 9/1970 | Brooks | 81/53.2 |
| 3,735,650 | 5/1973 | Weng | 81/53.2 |

FOREIGN PATENT DOCUMENTS

| | | | |
|---|---|---|---|
| 420194 | 11/1934 | United Kingdom | 29/265 |

*Primary Examiner*—Robert C. Watson

*Attorney, Agent, or Firm*—Timothy T. Patula; Ronald A. Sandler; Jerry A. Schulman

[57] ABSTRACT

A stud removing tool for removing a threaded stud from an associated stud mounting member having an elongated sleeve member with an internally threaded gripping end and an internally tapered stud locking end. A pilot member having a closed drive end, and an internally threaded bore end is provided. The drive end has an external angle of taper less than the internal angle of taper of the sleeve member, in which the angle of taper increases as it is directed toward the internally threaded bore end. The bore end of the pilot member has multiple finger splits directed from the open end to the closed end. When the tool is in use, the pilot is co-axially disposed in the sleeve member, with the bore end of the pilot threaded onto the end of a stud. A plug member is provided, having a driving end and an externally threaded mating end adapted to engage the internally threaded gripping end of the sleeve member and to axially abut the closed end of the pilot member. When the plug member is rotated within the sleeve, the plug member urges the pilot member co-axially along the sleeve toward the bore end until the external taper of the pilot member engages the internal taper of the sleeve member thereby forcing the finger splits on the pilot member to grip and frictionally lock on the free end of a stud. When the gripping end of the sleeve member is reversed, the stud is unthreaded from the associated stud mounting member. When the plug member is rotated in the opposite direction, the taper of the sleeve member and the taper of the pilot member may be disengaged by hand, thereby releasing the finger splits on the pilot member allowing the stud to be unthreaded from the tool.

11 Claims, 8 Drawing Figures

FIG. 1
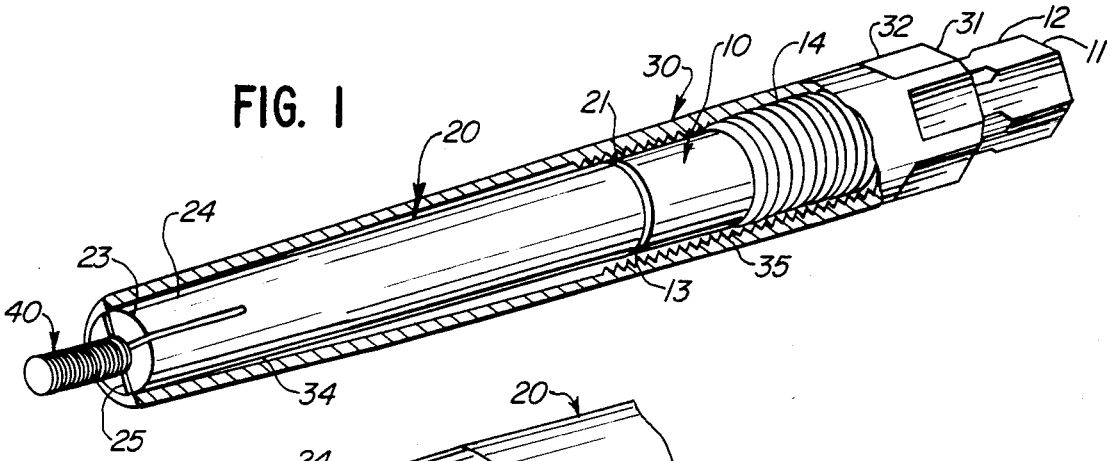
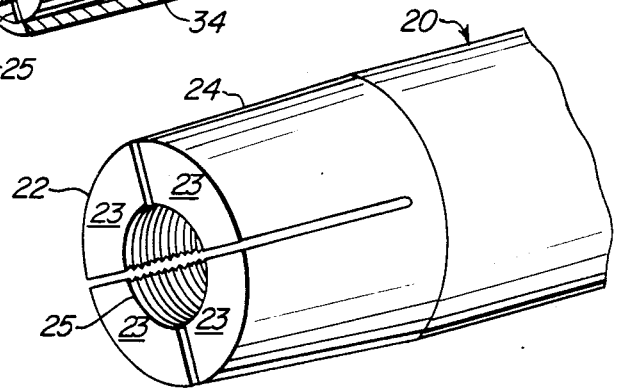
FIG. 6
FIG. 7
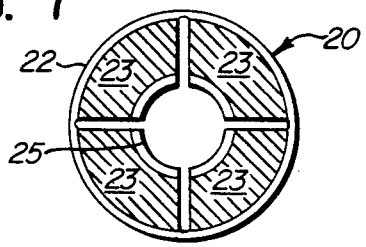
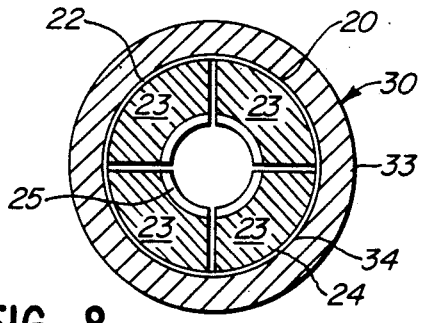
FIG. 8
FIG. 5
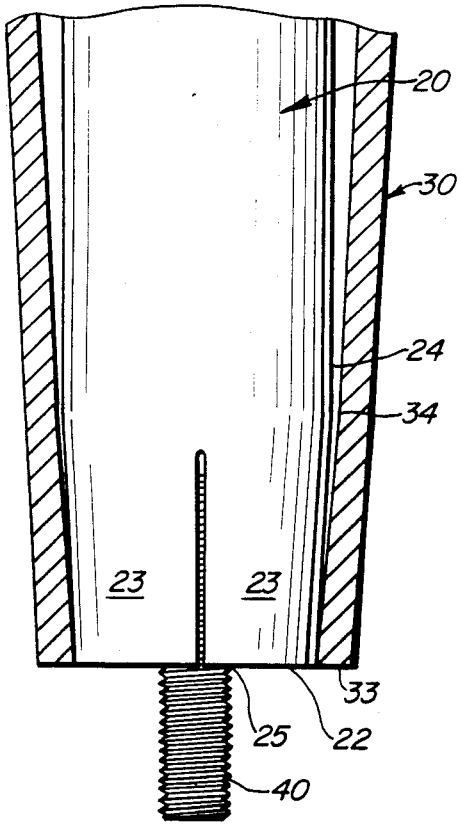

FIG. 2
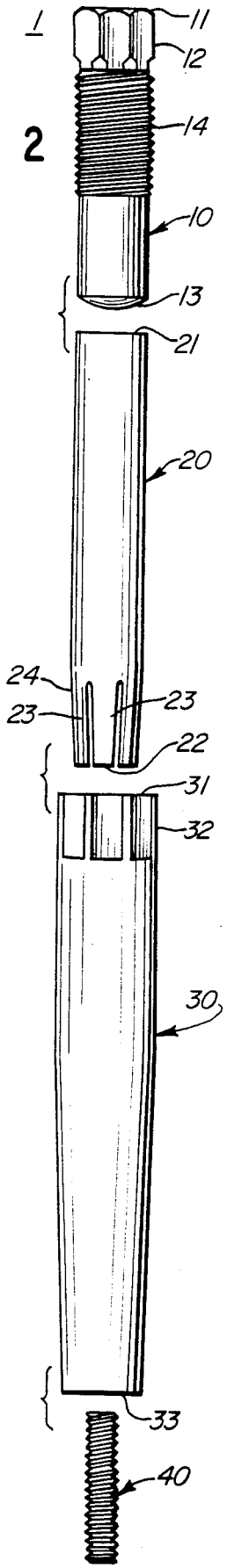
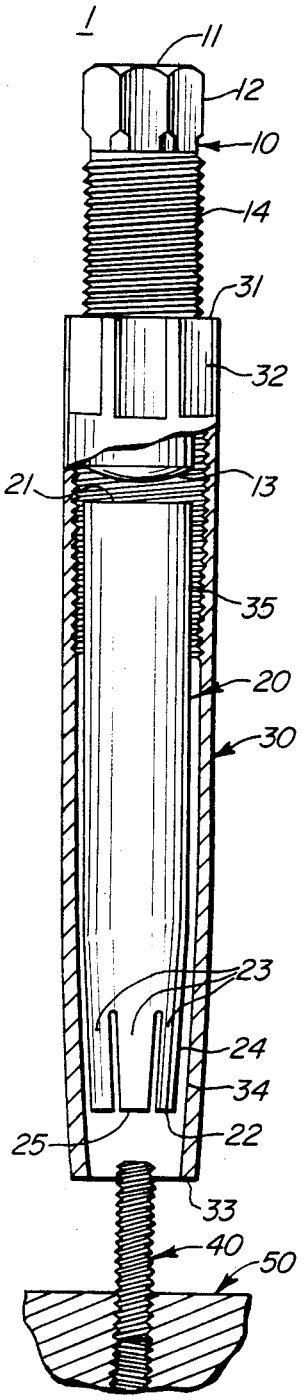
FIG. 3
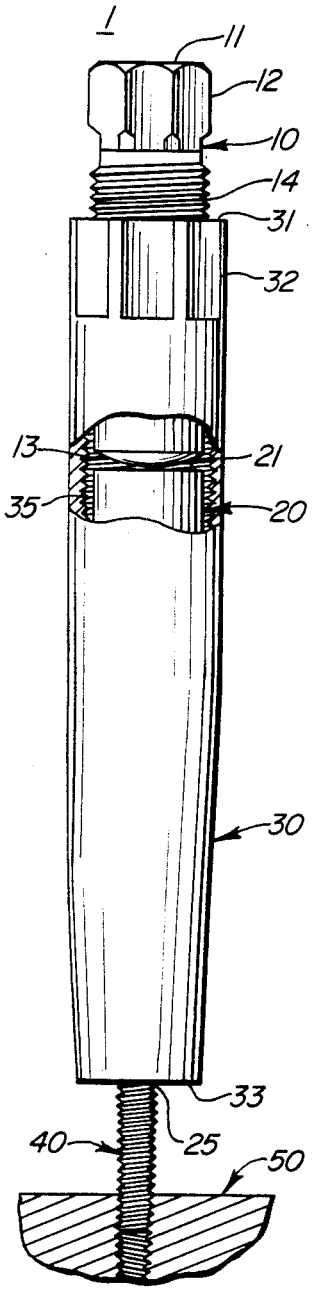
FIG. 4

DIFFERENT TAPER STUD REMOVER/INSTALLER

This invention relates generally to an improved device for pulling and removing headless bolts or studs and, particularly, for pulling and removing threaded studs of different diameters from devices with close clearances such as in aircraft, automobile, motorcycle, truck, snowmobile and other recreational type-vehicle engines and other mechanical devices.

BACKGROUND OF THE INVENTION

Many engines, transmissions and other mechanical devices use headless bolts or studs for the fastening of related components. As used herein, the term "stud" or "headless bolt" refers generally to a shaft having screw threads formed along part of all of its length. When disassembling components of an engine or other mechanical device for repair, studs must be removed without damaging the threads. The removal of these studs is often a difficult, tedious and very expensive task. One makeshift method commonly used is to "double nut" a stud by threading two nuts onto the stud to be removed, and tightening each nut against the other in opposite directions until they abut and fixedly lock onto the stud. The assembled double nut and stud combination is then removed from the required mechanical device using the double nuts as a "head" for a conventional wrench or socket tool. After the stud is removed, the nuts must be loosened by rotating each in opposite directions and then backed off from the removed stud. This cumbersome and time consuming method is eliminated by use of stud removal tools.

However, in the past many stud removal tools were complex, either requiring many individual pieces, or were of a design which required a considerable amount of effort and physical manipulation in removing the headless bolt from the associated mechanical device. Additionally, many of these tools were very expensive to manufacture because of the large number and intricacy of the individual components. Furthermore, many of these tools were of a design which damaged or created excessive wear of the studs' threads.

The principle object of the present invention is to provide a tool capable of removing or installing studs with a means for grasping the stud which does not utilize roller or stop pins, springs, washers, large perpendicularly extending handles, ball or needle bearings and neither injures nor causes wear of the studs' threads. A further object is to provide a tool capable of removing helicoils and dowel pins as well as studs and headless screws.

Another object of the invention is to provide an improved stud tool which is compact in design to facilitate removal of studs from locations with close clearances and other obstructions such as cooling fins on engine blocks. Therefore, a correlative object of the invention is to provide a long cylindrical tool which is longitudinally uninterrupted and which tapers inward toward its locking end to give it increased strength and rigidity. An additional object is to provide a tool which is very compact in design, allowing the tool to be used in tight places and such locations with close clearances where many other tools would require greater clearance to operate.

Still another object of the invention is to provide a tool which is easy and comparatively inexpensive to manufacture and which, in use, is efficient for removal of studs in repair work or for insertion of studs in mass production applications.

BRIEF SUMMARY OF THE INVENTION

The present invention consists of three component parts, a sleeve, pilot and locking plug. The pilot is constructed in various sizes for receiving studs of various diameters. The pilot is coaxially contained within the sleeve, in which the pilot has an exterior taper which is forced against the interior of the sleeve by the locking plug. This results in a compressed fit derived from the interfering pilot and sleeve tapers which compress the pilot's split fingers onto the stud, thereby creating a force over the stud to lock it within the tool.

The present invention augments efficiency of manufacture and use through integrally molded gripping means, whereby handles or external means are not needed to drive the tool and thereby remove the stud from the mechanical device and lock the tool.

Numerous other advantages and features of the invention will become readily apparent from the following detailed description of the preferred embodiment of the invention, from the claims and from the accompanying drawings in which like numerals are employed to designate like parts throughout.

To remove a stud from its mounted location, the stud is threaded into the receiving end of the respective size pilot co-axially contained within the sleeve. The locking plug is threaded to interengage the threads of the gripping end of the sleeve, thereby driving the pilot toward the stud and causing the differences in tapers between the pilot and sleeve to bind or interfere and cause the split fingers to grasp and firmly hold the stud. Once the stud is locked within the tool, the sleeve is rotated with the combination of locking plug, pilot and locked stud until the stud is removed from its mounted location.

After the stud is removed from its mounted location, the stud is removed from the tool by loosening the locking plug by open ended wrench or other means and then disengaging by hand the interfering tapers between the pilot and the sleeve, thereby allowing the split fingers to frictionally release the stud and allow the stud to be unscrewed from the loosened pilot.

In a similar fashion as described above, the present invention may be as equally effective in installing studs in a desired device.

BRIEF DESCRIPTION OF THE DRAWINGS

A fuller understanding of the foregoing may be had by reference to the accompanying drawings, wherein:

FIG. 1 is a perspective view of the stud removal/insertion tool of the present invention in partial cross-section with a stud engaged within the tool;

FIG. 2 is an exploded lateral view of the individual components of the present invention with a stud;

FIG. 3 is a lateral view in partial cross-section of the stud removal tool in preparation for removal of a stud from an associated mounting device;

FIG. 4 is a lateral view in partial cross-section showing a stud engaged and locked within the tool and depicting the locking plug in physical abutment to the pilot;

FIG. 5 is a partial cross-sectional view of the stud locking end of the pilot and sleeve, depicting the interference of the tapers between the pilot and sleeve to cause the pilot's finger splits to grip and lock a stud;

FIG. 6 is a partial perspective view of the threaded stud receiving end of a pilot of the present invention;

FIG. 7 is a top plan view of the stud receiving end of the pilot of the present invention; and FIG. 8 is a top plan view of the stud receiving end of the pilot co-axially engaged by the sleeve of the present invention.

DETAILED DESCRIPTION OF THE INVENTION

While this invention is susceptible of embodiment in many different forms, there is shown in the drawings and will herein be described in detail a preferred embodiment of the invention. The invention disclosed herein is equally applicable to many conventional stud insertion devices besides the embodiment shown and described below. It should be understood, however, that the present disclosure is to be considered as an exemplification of the principles of the invention and is not intended to limit the spirit and scope of the invention and/or claims to the embodiment illustrated.

The present invention is embodied in a stud remover-/installer tool which is comprised of three components: sleeve, pilot and locking plug.

The sleeve is comprised of an elongated cylinder with a locking end and a gripping end. The sleeve is hollow, compact in design, uninterrupted in its length, and has an interior taper along a portion of its length, which tapers inward slightly toward its locking end. The sleeve is also slightly tapered in its exterior to give it added rigidity and improved capacity for reaching studs mounted in locations with close clearances. Integrally molded gripping means are provided at the gripping end of the sleeve whereby, in the preferred embodiment as described below, an open end wrench allows the tool to lock onto and remove a mounted stud.

The pilot may be configured in various sizes for receiving studs of various diameters and thread pitches, and is comprised of a solid cylinder of uniform diameter along its length up to a point at which it tapers inward toward the stud receiving and locking end. At the stud receiving and locking end, an internally threaded and split bore with multiple fingers is formed. These multiple fingers extend toward the locking end of the pilot. The threaded bore is positioned co-axially within the pilot from less than about midway along the length of the pilot to receive the subject stud. The external taper of the pilot commences at the ends of the split fingers and is directed toward the stud receiving and locking end. The external taper of the pilot differs in degree from the corresponding internal taper of the sleeve. At the locking end, the interior taper of the sleeve is greater than that of the external taper of the pilot. In the preferred embodiment the sleeve has an internal taper of 5° and the pilot has an external taper of 3°.

A locking plug is provided with a driving means which may have a female socket means or open end wrench means and has a threaded intermediate portion adapted to engage with the corresponding internal threads on the locking end of the sleeve. The drive end of the locking plug may be arcuate.

In a preferred embodiment of the present invention, the tool is assembled by co-axially sliding one of the variously sized pilots into the sleeve via the gripping end and then inserting the locking plug to interengage the internal threads of the sleeve gripping end behind the pilot by interengaging the sleeve threads. The pilot, sleeve, and locking plug then thread onto and lock upon a stud to be removed. The grip end of the locking plug and the sleeve may each be wrench engaging, whereby a wrench is employed to tighten and drive the locking plug into contact with the closed end of the pilot. This action in turn pushes the pilot forward to cause the respective tapers of the sleeve and pilot to interfere at the open stud receiving end of the sleeve which in turn compresses and locks the fingers of the split bore of the pilot onto the stud to be removed or mounted.

After having gripped and locked onto a stud, the tool is then removed from its mounted location by rotating the tool and locked stud combination. After the stud is removed from its mounted location, the stud is released from the tool by loosening the locking plug by wrench, or other means, then by tapping the stud on a hard surface which disengages the pilot from the sleeve and releases the locking fit of the interfering tapers. Because the tapers no longer interfere, the split bore on the pilot releases its hold on the stud, allowing the stud to be easily unthreaded from the pilot. The stud is thereafter unscrewed and removed from the tool.

Referring now to FIG. 1, there is shown a perspective view of the stud removal insertion tool of the present invention, identified generally as numeral 1, in partial cross-section, with a stud 40 engaged within the tool 1. Sleeve 30 is depicted co-axially engaged with pilot 20. Driving plug 10 with closed driving end 13 is shown abutting pilot closed end 21. Stud 40 is shown threadably received within threaded bore 25 co-axially formed with open stud receiving end 22. Multiple split fingers 23 grasp and frictionally lock onto stud 40 responsive to the compression caused by pilot's 20 external taper 24 interfering with the sleeve's interior taper 34. Gripping end 11 of locking plug 10 is depicted with a hex configuration 12 for threads 14 to interengage interior threads 35 of sleeve 30. Sleeve 30, with a gripping end 31, is configured with a hex configuration 32 for rotatably driving tool 1.

In FIG. 2, a side view of the stud removal/insertion tool 1 of the present invention is shown. A locking plug 10 is depicted with a closed grasping end 11 configured in the preferred embodiment with a hex configuration 12 for use with an open ended wrench or other hex-engaging device. A closed driving end 13 is also depicted on locking plug 10 with threads 14 configured intermediately along the cylindrical shaft of locking plug 10.

The pilot is generally identified by the numeral 20, having a closed end 21 and an open stud receiving end 22 with multiple split fingers 23. External taper 24 is depicted with increasing severity from the commencement of the split fingers 23 to the stud receiving end 22.

The sleeve 30 has an open gripping end 31, with a hex configuration 32 shown positioned nearest the open gripping end 31. Open stud receiving end 33 is depicted as the other end of sleeve 30. A headless screw or threaded stud is shown generally as numeral 40.

FIG. 3 is a lateral view in partial cut-away of the stud removal tool 1 in preparation for removal of a stud 40 from an associated mounting device 50. Locking plug 10 is shown with gripping end 11 configured with a hex configuration 12 while threads 14 are in threadable engagement with sleeve 30 at open gripping end 31 which is configured for a hex configuration 32. Closed driving end 13 of locking plug 10 is shown spatially distanced from closed end 21 of pilot 20. Open stud receiving end 22 is likewise shown in spatial distance from stud 40 in which external taper 24 of pilot 20 is shown adjacent to, but not interfering with, interior taper 34 of sleeve 30. Multiple split fingers 23 are depicted in their rest or non-use state co-axilly positioned around threaded bore 25. Sleeve interior threads 35 and open stud receiving end 33 are further depicted.

Referring now to FIG. 4 in which is shown a lateral view in partial cut-away showing an associated mounting device 50 with a stud 40 engaged in tool 1 by and through open stud receiving end 33 of sleeve 30. Pilot 20 is shown by a partial cut-away view where closed end 21 is in contact and physical abutment with closed driving end 13 of locking plug 10. Interior threads 35 of the open gripping end 31 is further depicted. Hex configurations 12 and 32 are shown. Threads 14 are shown depicted outside of open gripping end 31. Gripping end 11 is also shown. Stud 40 is shown co-axially engaged within threaded bore 25.

FIG. 5 is a partial cross-sectional view of the open stud receiving end 22 of pilot 20 and open stud receiving end 33 of sleeve 30. Stud 40 is shown threadably engaged in threaded bore 25 and frictionally grasped and locked by multiple split fingers 23. Multiple split fingers 23 are shown in their locked or gripping position because of the interference of external taper 24 with interior taper 34.

FIG. 6 is a partial perspective view of the threaded stud receiving end 22 of pilot 20 depicting threaded bore 25. Multiple split fingers 23 and external tape 24 are further shown.

FIG. 7 is a end plan view of the stud receiving end 22 of pilot 20 depicting threaded bore 25 and multiple split fingers 23.

FIG. 8 is a end plan view of the stud receiving end 22 of pilot 20 being co-axially engaged by sleeve 30 at the stud receiving end 33 in which external taper 24 is shown in meeting to interior taper 34. Multiple split fingers 23 are also depicted in their grasping state.

Use of the present invention may be simply and effectively described as follows. The tool 1 is assembled by co-axially sliding one of the variously sized pilot 20 into the sleeve 30 at the open gripping end 31 as shown in FIG. 3. Then the tool 1, is threaded onto a mounted stud 40 mounted into an associated mounted device 50 into threaded bore 25. Locking plug 10 is then engaged with sleeve 30 by threads 14 and interior threads 35 until the closed driving end 13 meets and abuts closed end 21 forcing pilot 20 and external tape 24 to interfere with interior tape 34 of sleeve 30 as shown in FIG. 4. Locking plug 10 is tightened upon pilot 20 co-axially mounted within sleeve 30 by the use of a hex configuration 12 on gripping end 11. Hex configuration 32 on open gripping end 31 of sleeve 30 is used to prevent the movement of sleeve 30 while locking plug 10 is being tightened, by counteracting the rotation of hex configuration 12. The gripping end 11 of locking plug 10 and the sleeve 30 may be wrench engaging, whereby a wrench is employed to tighten and drive the locking plug 10 into contact with the closed end of the pilot 21. This action in turn pushes the pilot 20 forward to cause respective tapers 24 and 34 to interfere which in turn compresses split fingers 23 and locks stud 40 into the bore 25 to be removed or mounted.

The stud 40, locked within the tool, is removed from its mounting location 50 by rotating the tool 1 and the locked stud 40 combination. After the stud 40 is removed from its mounted location 50, the stud 40 is removed from the tool 1 by loosening the locking plug 10 by wrench or other means through hex configuration 12, tapping the stud 40 on a hard surface which disengages the pilot 20 from the sleeve 30 and releases the locking fit of the interfering tapers 24, 34. Because the tapers 24 and 34 no longer interfere, the split fingers 30 and bore 25 of the pilot 20 release the frictional hold on stud 40, allowing the stud to be easily unthreaded from the pilot 20. The stud 40 is thereafter unscrewed and removed from the tool 1.

The stud remover/installer tool may likewise be used to install studs by reversing the above procedure.

In another embodiment, left hand threads may be provided for threads 14 and 35. Left hand threads eliminate the need for an additional motion of rotating hex configuration 32 on sleeve 30 after locking driving end 13 against closed end 21 to remove the stud 40 from an associated mounting device 50. The use of left hand threads allows the locking plug 10 to be tightened against pilot 20 not only for grasping and locking the stud 40 but also to remove the stud 40 from an associated mounting device 50 by continuing to rotate locking plug 10 which will rotate the entire tool 1 and unthread stud 40 from the associated mounting device 50. This assumes that the stud 40 is threaded with right-hand threads.

The present invention is embodied in a tool which is useful in the removal not only of threaded studs but also for dowel pins, headless screws, helicoils and other devices used in fastening mechanical components together. The stud remover/installer tool may additionally be adapted to be driven by a conventional pneumatic or other rotatably driven power source.

While the foregoing has presented certain specific embodiments of the present invention, it is to be understood, that these embodiments have been presented by way of example only. It is expected that others will perceive variations which, while differing from the foregoing, do not depart from the spirit and scope of the invention as herein described and claimed.

What is claimed is:

1. A tool for removing or installing a threaded stud threadably to an associated stud mounting member, said tool comprising:

an elongated sleeve member having an internally threaded gripping end and an internally tapered stud locking end;

a pilot member having a closed drive end, and an internally threaded open bore end, said open bore end having an external angle of taper less than the internal angle of taper of said sleeve member, said angle being directed toward said internally threaded bore end, said bore end having multiple finger splits directed from said open end to said closed drive end, whereby in use said pilot member is disposed in said sleeve member, with said bore end of said pilot threaded onto the end of an associated threaded stud; and a plug member having a driving end and an externally threaded mating end adapted to engage said internally threaded gripping end of said sleeve member and to axially abut said closed end of said pilot member, whereupon rotating said plug member within said sleeve member said pilot member is urged co-axially along said sleeve member toward said bore end until said external tape of said pilot member engages the internal taper of said sleeve member, thereby forcing said finger splits on said pilot member to grip and frictionally lock onto the free end of an associated threaded stud within said sleeve and whereupon counter-rotation of said gripping end of said sleeve member causes the associated threaded stud to be unthreaded from the associated stud mounting member, whereby upon said plug member being rotated in the opposite direction said taper of said sleeve member and said taper of said pilot member may be disengaged by hand, thereby releasing said finger splits on said pilot member and allowing the associated threaded stud to be unthreaded from said pilot member.

2. The stud tool as recited in claim 1, wherein said sleeve member, pilot member and plug member are cylindrical in shape.

3. The stud tool as recited in claim 2, wherein said pilot member bore may be of different diameter to receive and correspond with variously sized studs.

4. The stud tool as recited in claim 3, wherein said taper of said sleeve member is tapered along a portion of said sleeve member; and said taper of said pilot member is tapered along a portion of said pilot member.

5. The stud tool as recited in claim 4, wherein said sleeve member has an internal angle of taper of 5° and said pilot member has an external angle of taper of 3°.

6. The stud tool as recited in claim 5, wherein said gripping end of said sleeve and said plug member is configured as a hex-drive configuration.

7. The stud tool as recited in claim 6, wherein said sleeve member and said plug member threads are left-hand threads.

8. A stud tool for removing or installing a threaded stud threadably to an associated stud mounting member, said tool comprising:

an elongated cylindrical sleeve member having an internally threaded gripping end and an internally tapered stud locking end, said internal taper extending a portion of said sleeve member;

a cylindrical pilot member having a closed drive end and an internally threaded bore end, said bore of variable dimension to receive and correspond to associated variously sized studs, said internally threaded bore end having an external angle of taper less than the internal angle of taper of said sleeve member, said angle of taper increasing along a portion of said pilot member as it is directed toward said internally threaded bore end, said bore end having multiple finger splits directed from said open end to said closed end, whereby in use said pilot member is co-axially disposed in said sleeve member with said bore end of said pilot member threaded onto the end of and associated threaded stud; and a cylindrical locking plug member having a driving end and an externally threaded mating end adapted to engage said internally threaded gripping end of said sleeve member and to axially abut said closed end of said pilot member, whereupon rotating said locking plug member within said sleeve urges said pilot member co-axially along said sleeve member toward said bore end until said external taper of said pilot member engages the internal taper of said sleeve member thereby forcing said finger splits on said pilot member to grip and frictionally lock onto the free end of an associated threaded stud within said sleeve, whereupon counter-rotation of said gripping end of said sleeve member, the associated threaded stud is unthreaded from the associated stud mounting member, whereby said plug member being rotated in the opposite direction allows said taper of said sleeve member and said taper of said pilot member to be disengaged by hand, thereby releasing said finger splits on said pilot member, allowing the associated threaded stud to be unthreaded from the tool.

9. The stud tool as recited in claim 8, wherein said cylindrical sleeve member has an internal angle of taper of 5° and said cylindrical pilot member has an external angle of taper of 3°.

10. The stud tool as recited in claim 9, wherein said sleeve member and said plug member threads are left-hand threads.

11. A stud inserting tool for inserting a threaded stud into an associated stud mounting member, said tool comprising:

an elongated sleeve member having an internally threaded gripping end and an internally tapered stud locking end;

a pilot member having a closed drive end, and an internally threaded bore end, said internally threaded bore end having an external angle of taper less than the internal angle of taper of said sleeve member, said angle of taper increasing as it is directed toward said internally threaded bore end, said bore end having multiple finger splits directed from said open end to said closed end, whereby in use, said pilot is disposed in said sleeve member, with said bore end of said pilot threaded onto the end of an associated threaded stud; and a plug member having a driving end and an externally threaded mating end adapted to engage said internally threaded gripping end of said sleeve member and to axially abut said closed end of said pilot member, whereupon an associated threaded stud is threaded into said bore end of said pilot member and said plug member rotated within said sleeve to urge said pilot member toward said bore end until said external taper of said pilot member engages the internal taper of said sleeve member, thereby forcing said finger splits on said pilot member to grip and frictionally lock onto the associated threaded stud, whereupon rotation of said gripping end of said sleeve member, the mounting end of the associated stud protruding from said tool is threadably received into the associated stud mounting member, whereby said plug member being rotated in the opposite direction allows said taper of said sleeve member and said taper of said pilot member to be disengaged, by hand, thereby releasing said finger splits on said pilot member and allowing said pilot member to be unthreaded from the mounted stud.

* * * * *